US009885991B2

(12) United States Patent
Arimoto

(10) Patent No.: US 9,885,991 B2
(45) Date of Patent: Feb. 6, 2018

(54) IMAGE FORMING APPARATUS AND CONTROL METHOD FOR AN IMAGE FORMING APPARATUS

(71) Applicant: CANON KABUSHIKI KAISHA, Tokyo (JP)

(72) Inventor: Kota Arimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/413,938

(22) Filed: Jan. 24, 2017

(65) Prior Publication Data

US 2017/0219979 A1 Aug. 3, 2017

(30) Foreign Application Priority Data

Feb. 3, 2016 (JP) ..... 2016-018647

(51) Int. Cl.
*G03G 15/00* (2006.01)
*G03G 15/01* (2006.01)

(52) U.S. Cl.
CPC ..... *G03G 15/5062* (2013.01); *G03G 15/01* (2013.01); *G03G 15/553* (2013.01); *G03G 2215/0129* (2013.01)

(58) Field of Classification Search
USPC .... 399/9, 15, 24, 26, 31, 38, 46–49, 55, 56, 399/72
See application file for complete search history.

(56) References Cited

U.S. PATENT DOCUMENTS 7,583,408 B2 9/2009 Maeda et al.
9,165,227 B2 * 10/2015 Yokoyama ..... G06K 15/1878
9,389,566 B2 * 7/2016 Takahashi ..... G03G 15/55

* cited by examiner

*Primary Examiner* — Hoan Tran
(74) *Attorney, Agent, or Firm* — Fitzpatrick, Cella, Harper & Scinto

(57) ABSTRACT

Provided is an image forming apparatus configured to appropriately determine that an abnormality has occurred in a component. The image forming apparatus includes: a charging device configured to charge a photosensitive drum; an exposure device configured to form an electrostatic latent image on the photosensitive drum charged by the charging device; a developing device including a carrying member configured to carry a toner and being configured to develop the electrostatic latent image using the toner to form a toner image; and a transfer portion configured to transfer the toner image onto a sheet. The image forming apparatus is configured to form a measurement image on the sheet, and to determine a unit that needs to be replaced based on a result of measuring the measurement image formed on the sheet. The measurement image includes a first measurement image and a second measurement image.

7 Claims, 12 Drawing Sheets

| | REPLACEMENT UNIT | IMAGE THAT HAS APPEARED | COLOR OF VERTICAL STREAK THAT HAS APPEARED | REPETITION CYCLE |
|---|---|---|---|---|
| DEVELOPMENT WHITE STREAK | DEVELOPING DEVICE FOR COLOR OF VERTICAL STREAK THAT HAS APPEARED | DIGITAL/ANALOG | SPECIFIC COLOR | NONE |
| PHOTOSENSITIVE DRUM CLEANING DEFECT STREAK | PROCESS CARTRIDGE FOR COLOR OF VERTICAL STREAK THAT HAS APPEARED | DIGITAL/ANALOG | SPECIFIC COLOR | NONE |
| INTERMEDIATE TRANSFER BELT CLEANING DEFECT STREAK | TRANSFER CLEANER | DIGITAL/ANALOG | ALL COLORS | NONE |
| PHOTOSENSITIVE DRUM SCRATCH STREAK | PROCESS CARTRIDGE FOR COLOR OF VERTICAL STREAK THAT HAS APPEARED | DIGITAL/ANALOG | SPECIFIC COLOR | CYCLE OF OUTER CIRCUMFERENCE DRUM |
| INTERMEDIATE TRANSFER BELT DEFORMATION WHITE STREAK | TRANSFER UNIT | DIGITAL/ANALOG | ALL COLORS | NONE |
| EXPOSURE DEFECT WHITE STREAK | EXPOSURE DEVICE (CLEANING MAINTENANCE) | ANALOG | SPECIFIC COLOR | NONE |

FIG. 3

IMAGE DIAGNOSIS

DIAGNOSIS RESULT:
PROBLEM HAS OCCURRED IN IMAGE QUALITY!
STREAK HAS APPEARED IN SUB-SCANNING DIRECTION

CODE: ○○○○
REPLACEMENT UNIT: △△△△

OK

FIG. 11

IMAGE FORMING APPARATUS AND CONTROL METHOD FOR AN IMAGE FORMING APPARATUS

BACKGROUND OF THE INVENTION

Field of the Invention

The present invention relates to an image forming apparatus, e.g., a copying machine or a printer.

Description of the Related Art

An electrophotographic image forming apparatus includes a photosensitive member, a charging device configured to charge the photosensitive member, an exposure device configured to expose the charged photosensitive member to form an electrostatic latent image, and a developing device configured to develop the electrostatic latent image with a developer. The image forming apparatus is configured to transfer an image onto a sheet, and to then cause a fixing device to fix the image to the sheet by heat and pressure.

In this case, for example, a streak-like image (hereinafter referred to as "vertical streak image") may appear in the image formed on the sheet due to a stain of the exposure device, coating unevenness of the developer caused by the developing device, a scratch on a surface of the photosensitive member, or the like. For example, an image forming apparatus described in U.S. Pat. No. 7,583,408 is configured to form a measurement image on an image bearing member, and to determine whether or not an abnormality has occurred in the image formed by the image forming apparatus based on a result of detecting the measurement image by a sensor.

However, the image forming apparatus described in U.S. Pat. No. 7,583,408 is unable to determine that an abnormality has occurred when, for example, the abnormality has occurred in a transfer portion configured to transfer the image onto the sheet. Therefore, the present invention has an object to appropriately determine that an abnormality has occurred in a component of the image forming apparatus.

SUMMARY OF THE INVENTION

An image forming apparatus according to the present disclosure includes a first image forming unit configured to form an image in a first chromatic color; a second image forming unit configured to form an image in a second chromatic color different from the first chromatic color; and a controller configured to: control the first image forming unit and the second image forming unit to form, on a sheet, a superimposed measurement image in which a first measurement image in the first chromatic color is superimposed on a second measurement image in the second chromatic color; acquire read data relating to the superimposed measurement image formed on the sheet; analyze the read data; and detect a streak image within the first measurement image and a streak image within the second measurement image based on a result of the analysis, wherein: the read data is output from a reading device; the first image forming unit comprises: a first photosensitive member; a first charging unit configured to charge the first photosensitive member; a first exposure unit configured to expose the first photosensitive member to form an electrostatic latent image on the first photosensitive member; and a first developing unit configured to develop the electrostatic latent image on the first photosensitive member using a developer of the first chromatic color on a first sleeve; the second image forming unit comprises: a second photosensitive member; a second charging unit configured to charge the second photosensitive member; a second exposure unit configured to expose the second photosensitive member to form an electrostatic latent image on the second photosensitive member; and a second developing unit configured to develop the electrostatic latent image on the second photosensitive member using a developer of the second chromatic color on a second sleeve; the controller is configured to control the first image forming unit so that an absolute value of a first developing bias applied to the first sleeve becomes larger than an absolute value of a surface potential of the first photosensitive member charged by the first charging unit in order to form the first measurement image; and the controller is configured to control the second image forming unit so that an absolute value of a second developing bias applied to the second sleeve becomes larger than an absolute value of a surface potential of the second photosensitive member charged by the second charging unit in order to form the second measurement image.

Further features of the present invention will become apparent from the following description of exemplary embodiments (with reference to the attached drawings).

BRIEF DESCRIPTION OF THE DRAWINGS

FIG. 3 is an explanatory diagram of relationships between kinds of vertical streaks and components to be replaced.

FIG. 11 is an exemplary diagram of a notification image displayed when there is a problem in image quality.

DESCRIPTION OF THE EMBODIMENTS

Referring to the accompanying drawings, an embodiment of the present invention is described below.

Image Forming Apparatus

Figure 1:
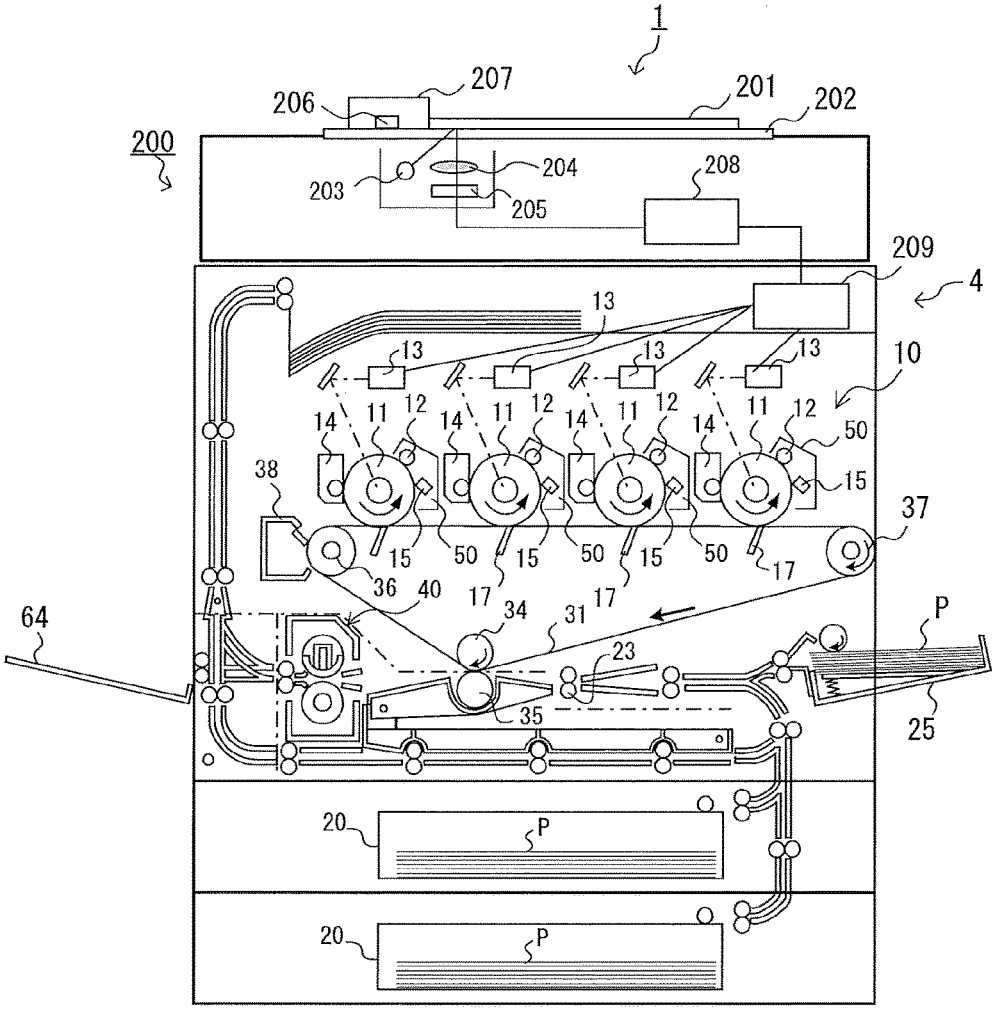
FIG. 1 is a configuration diagram of an image forming apparatus.

FIG. 1 is a configuration diagram of an image forming apparatus 1 according to this embodiment. The image forming apparatus 1 includes an image reading section 200 and a printer section 4.

The image reading section 200 includes an original table 202, a light source 203, an optical system 204, a light receiver 205, a reference white board 206, a baffle member 207, and a read image processing portion 208. The original table 202 is made of glass, and an original 201 to be read is placed on the original table 202. The light source 203 is configured to irradiate the original 201 placed on the original table 202 with light. The optical system 204 is configured to image the light emitted from the light source 203 and reflected by the original 201 onto the light receiver 205. The light receiver 205 is, for example, a group of charge-coupled-device (CCD) line sensors for red, green, and blue that are arrayed in three rows, and is configured to receive the light reflected by the original 201. The light receiver 205 is configured to transmit a color component signal being an electric signal of the corresponding color to the read image processing portion 208 for each line based on the received light. The read image processing portion 208 is configured to conduct image processing for the color component signal acquired from the light receiver 205, to thereby transmit a generated image signal to the printer section 4.

The printer section 4 includes an image forming portion 10, an intermediate transfer belt 31, a fixing device 40, a conveyance system configured to convey a sheet P, and a printer control portion 209. The printer section 4 is configured to cause the printer control portion 209 to acquire the image signal transmitted from the read image processing portion 208 of the image reading section 200. The printer control portion 209 is configured to control image forming processing conducted by the printer section 4. The image forming portion 10 is configured to generate toner images in respective colors of yellow, magenta, cyan, and black. The image forming portion 10 is configured to transfer the toner images in the respective colors onto the intermediate transfer belt 31 being an intermediate transfer member. The intermediate transfer belt 31 is configured to transfer the transferred toner images onto the sheet P conveyed by the conveyance system. The fixing device 40 is configured to fix the toner images to the sheet P onto which the toner images have been transferred. The sheet P to which the toner images have been fixed is delivered onto a delivery tray 64 provided to the image forming apparatus 1.

Four image forming portions 10 are provided so as to correspond to the respective colors of yellow, magenta, cyan, and black, and each includes a photosensitive drum 11, a charging device 12, an exposure device 13, a developing device 14, and a drum cleaner 15. In FIG. 1, the image forming portion 10 configured to generate the toner image in yellow, the image forming portion 10 configured to generate the toner image in magenta, the image forming portion 10 configured to generate the toner image in cyan, and the image forming portion 10 configured to generate the toner image in black are arrayed in a row in the stated order from the left of the drawing.

In this embodiment, the photosensitive drum 11 is a drum-shaped photosensitive member having an outer diameter of 30 mm and a circumference of approximately 94.2 mm. The photosensitive drum 11 is configured to be rotated by a drive source (not shown) counterclockwise as viewed in the drawing. The charging device 12, the exposure device 13, the developing device 14, and the drum cleaner 15 are arranged around the photosensitive drum 11. A primary transfer blade 17 is arranged in a position opposed to the photosensitive drum 11 across the intermediate transfer belt 31. The toner image is formed on the photosensitive drum 11.

In this embodiment, in the developing device 14, a two-component developer formed of a non-magnetic toner and a low-magnetization high-resistance carrier is used as a developer. The non-magnetic toner is formed by using appropriate amounts of: a binder resin, e.g., a styrene-based resin or a polyester resin; a colorant, e.g., a carbon black, a dye, or a pigment; a release agent, e.g., wax; a charge control agent; and the like. Such a non-magnetic toner is manufactured by a method, for example, a pulverization method or a polymerization method. Examples of a magnetic carrier to be used include a resin carrier formed by dispersing magnetite in a resin as a magnetic material and dispersing a carbon black in order to achieve conductivity and adjust resistance. Another example of the magnetic carrier to be used is a carrier formed by oxidizing or reducing a surface of a single magnetite material, e.g., ferrite, for resistance adjustment. Further, another example of the magnetic carrier to be used is a carrier formed by coating the surface of a single magnetite material, e.g., ferrite, with a resin for the resistance adjustment.

The intermediate transfer belt 31 is looped around a secondary transfer inner roller 34 and rollers 36 and 37, and is configured to rotate clockwise as viewed in the drawing. The secondary transfer inner roller 34 and a secondary transfer outer roller 35 sandwich the intermediate transfer belt 31, and form a secondary transfer portion. The secondary transfer portion causes toner images to be transferred from the intermediate transfer belt 31 onto the sheet P. The fixing device 40 fixes the toner images to the sheet P onto which the toner images have been transferred.

The sheet P is received in a sheet feeding cassette 20 or placed on a sheet feeding tray 25. The conveyance system controls the driving of the respective conveyance rollers after the sheet P is fed from the sheet feeding cassette 20 or the sheet feeding tray 25 until the sheet P is delivered onto the delivery tray 64 under control of the printer control portion 209. The conveyance system includes a registration roller pair 23 on upstream of the secondary transfer portion. The registration roller pair 23 conducts skew feed correction for the sheet P. The registration roller pair 23 conveys the sheet P to the intermediate transfer belt 31 at a timing suitable for a timing at which the intermediate transfer belt 31 is to carry the toner images to the secondary transfer portion.

The printer section 4 having the above-mentioned configuration forms an image on the sheet P in the following manner. First, the photosensitive drum 11 of the image forming portion 10 has the surface charged uniformly by the charging device 12. The exposure device 13 forms an electrostatic latent image in the color corresponding to the photosensitive drum 11 by irradiating the charged photosensitive drum 11 with laser light modulated by the image signal of the corresponding color under the control of the printer control portion 209. The developing device 14 develops the electrostatic latent image with a developer including a toner of the corresponding color, to thereby form a toner image on the photosensitive drum 11.

The toner image formed by each photosensitive drum 11 is primarily transferred onto the intermediate transfer belt 31 by the primary transfer blade 17. The toner remaining on the photosensitive drum 11 after the transfer is removed by the drum cleaner 15. The photosensitive drum 11 from which the toner has been removed by the drum cleaner 15 becomes ready to form a subsequent toner image. The intermediate transfer belt 31 has the toner images transferred from the respective photosensitive drums 11 so as to be superimposed on each other. With this configuration, a full-color toner image is formed on the intermediate transfer belt 31.

The sheets P are conveyed from the sheet feeding cassette 20 or the sheet feeding tray 25 to the registration roller pair 23 one by one by the conveyance system. The registration roller pair 23 conducts the skew feed correction for the conveyed sheet P, and stands by until a timing to convey the sheet P to the secondary transfer portion. The registration roller pair 23 conveys the sheet P to the secondary transfer portion at the timing suitable for the timing at which the toner images formed on the intermediate transfer belt 31 are to be carried to the secondary transfer portion. The secondary transfer portion secondarily transfers the toner images formed on the intermediate transfer belt 31 onto the sheet P. While conducting the secondary transfer, the secondary transfer portion conveys the sheet P to the fixing device 40 by the rotation of the secondary transfer inner roller 34 and the secondary transfer outer roller 35. The toner remaining on the intermediate transfer belt 31 after the secondary transfer is removed by a transfer cleaner 38, and the intermediate transfer belt 31 becomes ready for subsequent image formation. The fixing device 40 heats and pressurizes the sheet P, to thereby cause the toner image to adhere to the sheet P. The fixing device 40 delivers the sheet P to which the image has been fixed to the delivery tray 64.

Such an image forming apparatus 1 employs a replaceable replacement unit for a part of components in order to facilitate maintenance. As a typical replacement unit, there is a process unit obtained by integrating the photosensitive drum 11 with at least one of a toner cartridge configured to receive a toner, the charging device 12, the developing device 14, and the drum cleaner 15.

In this embodiment, the photosensitive drum 11, the charging device 12, and the drum cleaner 15 are integrally formed as one process cartridge 50. The process cartridge 50 is a component (unit) removably attached to a main body of the image forming apparatus 1. The process cartridge 50 allows the photosensitive drum 11, the charging device 12, and the drum cleaner 15 to be replaced at a time. The exposure device 13 is a component (unit) removably attached to the main body of the image forming apparatus 1. The developing device 14 is a component (unit) removably attached to the main body of the image forming apparatus 1. Each of the image forming portions 10 for the respective colors may be provided as one component (unit) removably attached to the main body of the image forming apparatus 1. The primary transfer blade 17 and the intermediate transfer belt 31 are integrally formed as a transfer unit. The transfer unit is a component (unit) removably attached to the main body of the image forming apparatus 1. The transfer unit allows the primary transfer blade 17 and the intermediate transfer belt 31 to be replaced at a time. The transfer cleaner 38 is a component (unit) removably attached to the main body of the image forming apparatus 1. Those components (units) removably attached to the main body of the image forming apparatus 1 can be replaced with ease. Therefore, complication in the maintenance of the image forming apparatus 1 is resolved, and a maintenance time period is shortened, which improves convenience.

Controller

Figure 2:
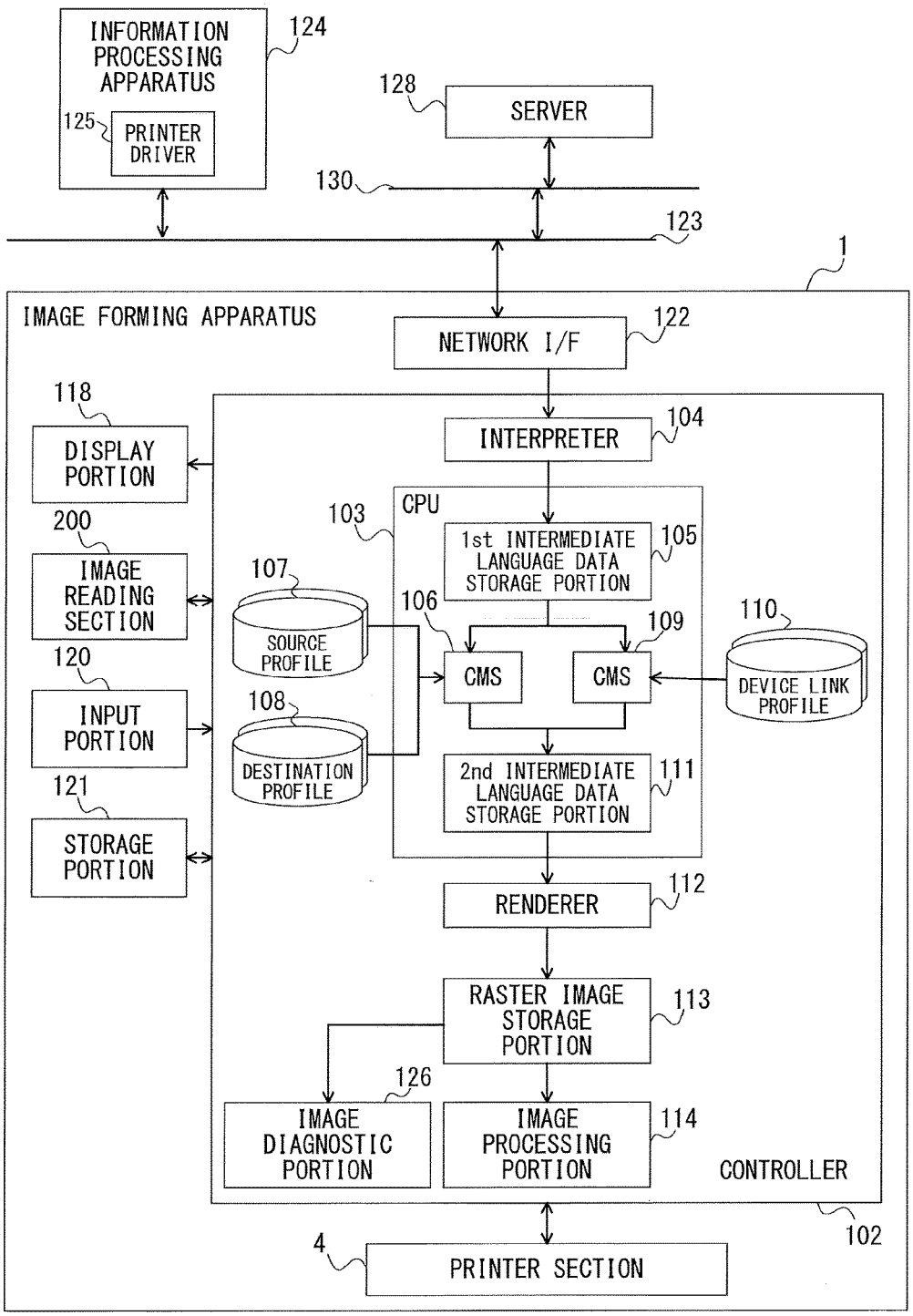
FIG. 2 is a configuration diagram of a controller.

FIG. 2 is a configuration diagram of a controller configured to control an operation of the image forming apparatus 1. A controller 102 is built into the image forming apparatus 1. The image forming apparatus 1 is capable of communicating with an information processing apparatus 124 and a server 128, which are external apparatus, through networks 123 and 130. The information processing apparatus 124 includes a printer driver 125, and is configured to transmit print data including information relating to image formation to the image forming apparatus 1 through the network 123. The server 128 is configured to transmit print data including information relating to image formation to the image forming apparatus 1 through the networks 123 and 130. The network 130 and the network 123 are separate network environments connected to each other and located apart from each other at, for example, external buildings. There may be provided a plurality of information processing apparatus 124 and a plurality of servers 128.

In order to control operations of the printer section 4 and the image reading section 200 that are described above, the image forming apparatus 1 includes the controller 102, a network I/F 122, a display portion 118, an input portion 120, and a storage portion 121.

The network I/F 122 is a communication interface between the information processing apparatus 124 and the server 128. The network I/F 122 is configured to receive the print data transmitted from the information processing apparatus 124 and the server 128. The network I/F 122 is configured to transmit the received print data to the controller 102.

The controller 102 includes an interpreter 104, a central processing unit (CPU) 103, a renderer 112, a raster image storage portion 113, an image processing portion 114, and an image diagnostic portion 126. In order to analyze the print data, the controller 102 includes a source profile storage portion 107, a destination profile storage portion 108, and a device link profile storage portion 110. The controller 102 is not only formed of a discrete product but also achieved by, for example, a one-chip semiconductor product. Examples of the one-chip semiconductor product include a microprocessing unit (MPU), an application specific integrated circuit (ASIC), and a system-on-a-chip (SOC).

The interpreter 104 is configured to acquire the print data from the network I/F 122. The interpreter 104 is configured to input the acquired print data to the CPU 103. The CPU 103 is configured to analyze a page description language (PDL) part of the acquired print data from the interpreter 104, and to generate intermediate language data. The generated intermediate language data is stored in a first intermediate language data storage portion 105. The CPU 103 includes two CMSs 106 and 109, and color conversion of the intermediate language data is conducted using the CMSs 106 and 109 to generate the intermediate language data (after CMS). The intermediate language data (after CMS) is stored in a second intermediate language data storage portion 111. Which of the CMS 106 and the CMS 109 is to be used to conduct the color conversion is set by, for example, the printer driver 125.

The CMS 106 is configured to conduct the color conversion of the intermediate language data using a source profile stored in the source profile storage portion 107 and a destination profile stored in the destination profile storage portion 108. The "source profile" is a profile for converting a device-dependent color space, e.g., RGB or CMYK, into a device-independent color space, e.g., L*a*b or XYZ defined by the International Commission on Illumination (CIE). In XYZ, colors are expressed by tristimulus values. The "destination profile" is a profile for converting the device-independent color space into a CMYK color space dependent on the image forming apparatus 1.

The CMS 109 is configured to conduct the color conversion of the intermediate language data using a device link profile stored in the device link profile storage portion 110. The "device link profile" is a profile for directly converting the device-dependent color space, e.g., RGB or CMYK, into the CMYK color space dependent on the image forming apparatus 1.

The renderer 112 is configured to acquire the intermediate language data (after CMS) from the second intermediate language data storage portion 111 to generate a raster image. The renderer 112 is configured to store the generated raster image in the raster image storage portion 113. The image processing portion 114 is configured to acquire the raster image from the raster image storage portion 113, and to subject the raster image to image processing for use in the image forming processing to be conducted by the printer section 4. The image processing portion 114 is also configured to subject the image signal acquired from the image reading section 200 to the image processing for use in the image forming processing to be conducted by the printer section 4. The image diagnostic portion 126 is configured to form a measurement chart (measurement image) to be used for problem analysis on the sheet P in a case where a problem occurs in image quality of the formed image. The measurement chart formed on the sheet P is used for image diagnostic processing described later.

The display portion 118 is an output interface configured to display images indicating an instruction for a user and a status of the image forming apparatus 1. The input portion 120 is an input interface configured to receive input through the user's operation. The input portion 120 includes various operation buttons and a touch panel integrated with the display portion 118. The storage portion 121 is configured to store data processed by the controller 102 and various kinds of data acquired by the controller 102.

Vertical Streak Image

As one of abnormalities that occur in the image formed on the sheet P, there is a vertical streak image that appears along a conveyance direction of the sheet P. Examples of a cause of appearance of the vertical streak image include a stain of the exposure device 13, coating unevenness of the developer caused by the developing device 14, a scratch on the surface of the photosensitive drum 11, damage done to the photosensitive drum 11 by the drum cleaner 15, and a deformation of the intermediate transfer belt 31. There is also a case where an abnormality occurs in the secondary transfer portion to cause an abnormality in the image formed on the sheet P.

In this embodiment, an image is formed on a sheet, and it is determined which component has caused an abnormality based on a result of reading the image. Hitherto, a large number of sheets are required to be output in order to form images in the respective colors on the sheet independently and determine which component has caused an abnormality, and work of reading the sheet becomes complicated. The increase in number of sheets to be used is not preferable from the viewpoint of an environmental load.

A description is made of a relationship between each replaceable component of the image forming apparatus 1 and a vertical streak image that appears in the formed image. FIG. 3 is an explanatory diagram of relationships between kinds of vertical streak image and components to be replaced (replacement units). The kinds of the vertical streak image include a "development white streak", a "photosensitive drum cleaning defect streak", an "intermediate transfer belt cleaning defect streak", a "photosensitive drum scratch streak", an "intermediate transfer belt deformation white streak", and an "exposure defect white streak". The image forming apparatus 1 stores a table for showing such relationships between the vertical streak images and the replacement units in a predetermined memory area in advance.

Figure 4A:
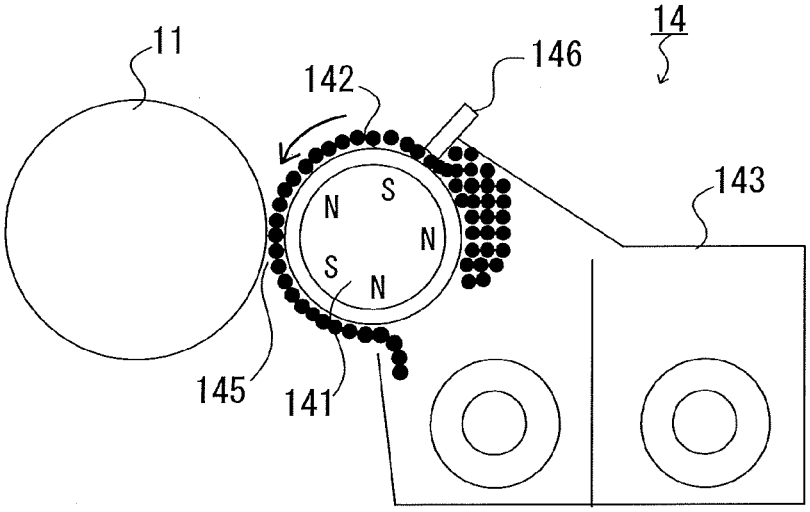
FIG. 4A and FIG. 4B are explanatory diagrams of a state in which a developing sleeve is coated with a developer.
Figure 4B:
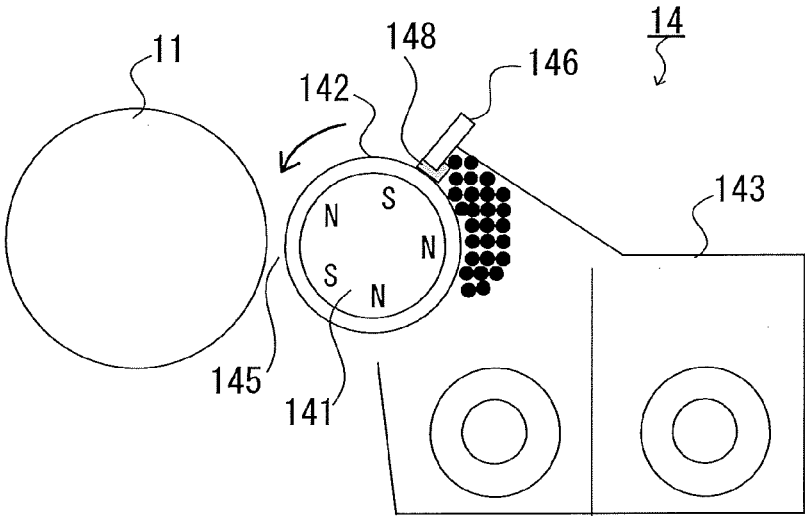

The "development white streak" is a streak image that appears depending on a state in which a developing sleeve of the developing device 14 is coated with a developer. FIG. 4A and FIG. 4B are explanatory diagrams of the state in which the developing sleeve is coated with the developer. As illustrated in FIG. 4A, the developing device 14 includes a developing sleeve 142 which contains a magnet 141 as a carrying member for the developer, and which is supported by a developing container 143 so as to be free to rotate. The developing sleeve 142 is configured to rotate counterclockwise as viewed in the drawing. The developing sleeve 142 has the surface coated with a developer, and supplies the developer to the photosensitive drum 11 at a closest part 145 to the photosensitive drum 11. An amount (thickness) of the developer caused to adhere to the developing sleeve 142 is regulated by a regulating blade 146. This guarantees the amount of the developer to be supplied to the photosensitive drum 11 at the closest part 145.

Figure 5:
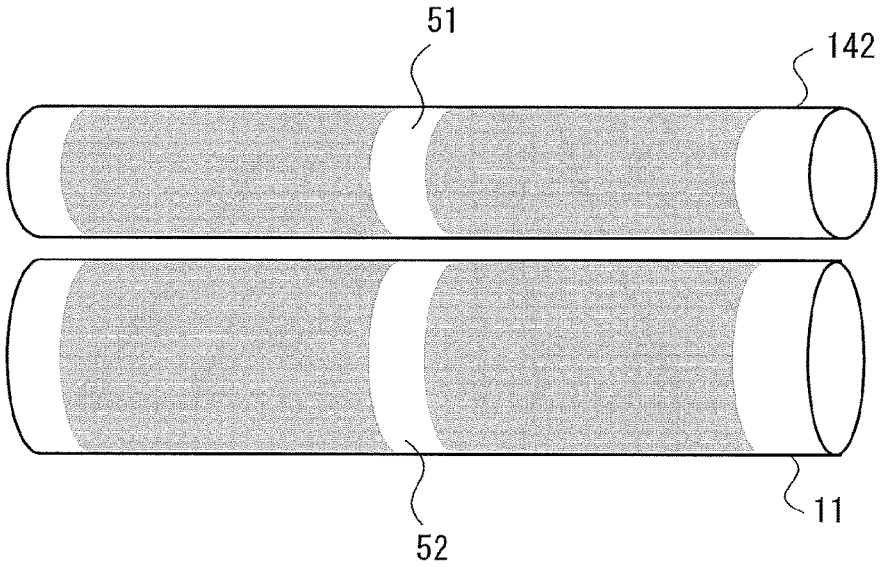
FIG. 5 is a diagram for exemplifying how the developer adheres to the developing sleeve and a photosensitive drum.

As illustrated in FIG. 4B, in a case where foreign matter 148, e.g., hair, is stuck at a part between the developing sleeve 142 and the regulating blade 146, the developing sleeve 142 fails to be coated in the above-mentioned part with the developer. FIG. 5 is a diagram for exemplifying how the developer adheres to the developing sleeve 142 and the photosensitive drum 11 in the above-mentioned state. The developing sleeve 142 exhibits an area 51 in which the developer is not borne due to the influence of the foreign matter 148. This causes the photosensitive drum 11 to exhibit an area 52 of not being developed. In the thus-formed image, a continuous white streak appears in a straight line due to the area 52. The "development white streak" is caused in this manner. The cause lies in the foreign matter 148 of the developing device 14, and hence the unit to be replaced in order to resolve the development white streak is the developing device 14.

The "photosensitive drum cleaning defect streak" is a streak image that appears due to a cleaning defect of the photosensitive drum 11 caused by the drum cleaner 15. The photosensitive drum cleaning defect streak appears because a part of the drum cleaner 15 in abutment with the photosensitive drum 11 is chipped to inhibit the toner remaining on the photosensitive drum 11 from being cleared after the transfer. The color of the streak image that has appeared is a color of the image formed on the photosensitive drum 11. A yellow streak image appears in the case of the cleaning defect of the photosensitive drum 11 on which the image in yellow is formed. A magenta streak image appears in the case of the cleaning defect of the photosensitive drum 11 on which the image in magenta is formed. A cyan streak image appears in the case of the cleaning defect of the photosensitive drum 11 on which the image in cyan is formed. A black streak image (black streak) appears in the case of the cleaning defect of the photosensitive drum 11 on which the image in black is formed. The streak image due to the cleaning defect of the photosensitive drum 11 continuously appears on the image, in particular, on the sheet P in a white ground part, substantially in a straight line. The cause lies in the cleaning defect of the photosensitive drum 11, and hence the unit to be replaced in this case is the process cartridge 50 corresponding to the color of the streak image that has appeared.

The "intermediate transfer belt cleaning defect streak" is a streak image that appears due to a cleaning defect of the intermediate transfer belt 31 caused by the transfer cleaner 38. The intermediate transfer belt cleaning defect streak appears because a part of the transfer cleaner 38 in abutment with the intermediate transfer belt 31 is chipped to inhibit the toner remaining on the intermediate transfer belt 31 in the chipped part from being cleared after the secondary transfer. The streak image that has appeared exhibits a mixed color of the respective colors of yellow, magenta, cyan, and black.

The cause lies in the cleaning defect of the intermediate transfer belt 31, and hence the unit to be replaced in this case is the transfer cleaner 38.

The "photosensitive drum scratch streak" is a streak image that appears due to a scratch on the photosensitive drum 11. The photosensitive drum scratch streak appears because, for example, a concave scratch appears on the surface of the photosensitive drum 11 when the photosensitive drum 11 is rotated with high-hardness foreign matter being sandwiched between the drum cleaner 15 and the photosensitive drum 11. The photosensitive drum 11 is not sufficiently charged in the part of the concave scratch by the charging device 12, and exhibits a lower potential of the electrostatic latent image than in other parts. Hence, at a time of development, the electrostatic latent image is developed with a larger amount of toner than in other parts, which increases a density of the image on the sheet P. When a scratch appears on the photosensitive drum 11, the streak image on the sheet P appears with a cycle of an outer circumferential length (in this case, approximately 94.2 mm) of the photosensitive drum 11. Therefore, in order to positively detect the streak image, it is necessary to form an image having a length equal to or longer than the outer circumferential length of the photosensitive drum 11 in the conveyance direction of the sheet P. The cause lies in the scratch on the photosensitive drum 11, and hence the unit to be replaced in this case is the process cartridge for the color of the streak image that has appeared.

Figure 6:
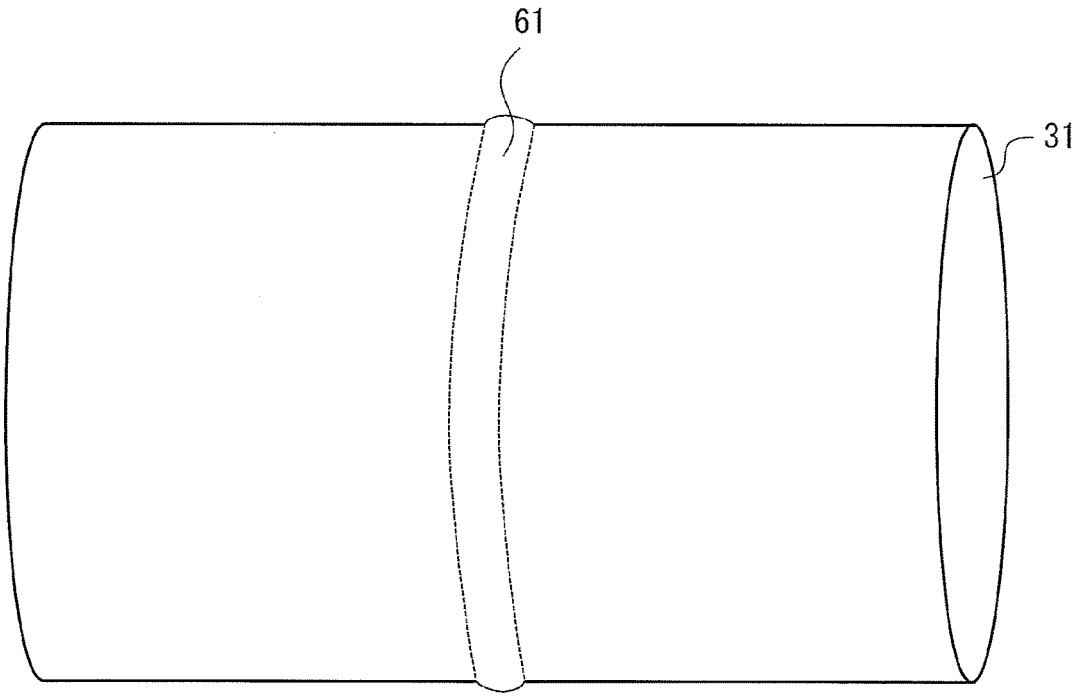
FIG. 6 is a diagram for exemplifying a state in which an intermediate transfer belt has been plastically deformed into a convex shape.

The "intermediate transfer belt deformation white streak" is a streak image that appears due to the plastic deformation of the intermediate transfer belt 31. The intermediate transfer belt 31 may become deformed into a convex shape in a part in which an inner scraped powder adheres to the rollers 36 and 37 due to long-term use. FIG. 6 is a diagram for exemplifying a state in which the intermediate transfer belt 31 has been plastically deformed into a convex shape. When a deformed part 61 having a convex shape appears on the intermediate transfer belt 31, parts on both sides of the deformed part 61 become difficult to be brought into contact with the photosensitive drum 11 and the sheet P at a time of the transfer. For that reason, the above-mentioned parts of the image formed on the sheet P become white vertical streak images. The white vertical streak images appear in all the colors of yellow, magenta, cyan, and black. The cause lies in the plastic deformation of the intermediate transfer belt 31, and hence the unit to be replaced in this case is the transfer unit.

Figure 7:
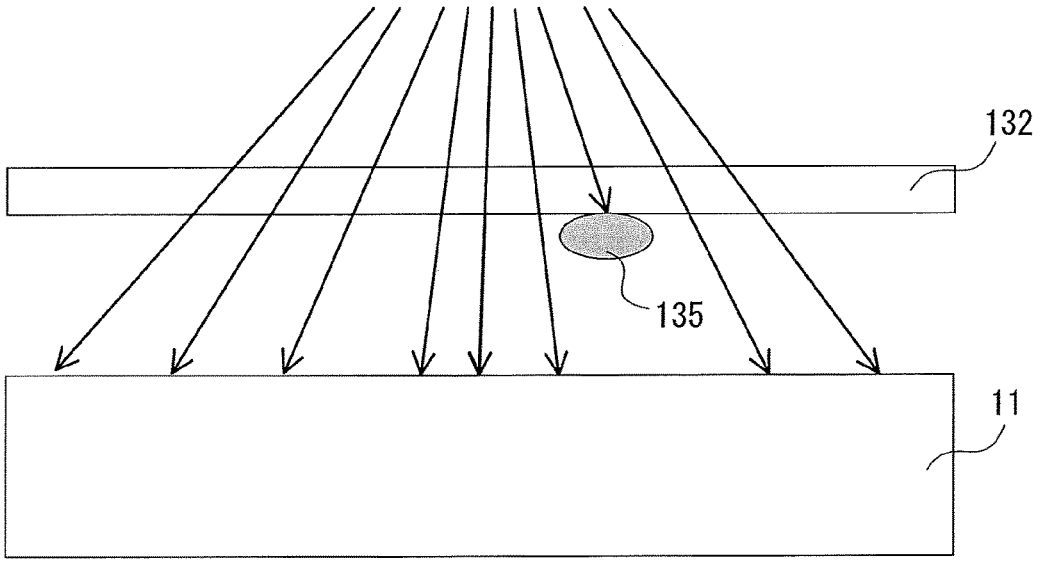
FIG. 7 is an explanatory diagram of a state in which exposure with laser light is blocked.

The "exposure defect white streak" is a streak image that appears due to blocking of the exposure of the photosensitive drum 11 with the laser light emitted from the exposure device 13. FIG. 7 is an explanatory diagram of a state in which the exposure with the laser light is blocked. FIG. 7 is an illustration of a state in which foreign matter 135 (dust, hair, toner, or the like) adheres to a dust-proof window 132 of the exposure device 13. A part of the laser light emitted from the exposure device 13 is blocked by the foreign matter 135, which inhibits the electrostatic latent image from being formed on the photosensitive drum 11. This causes a white vertical streak image. The cause lies in an exposure defect caused by the exposure device 13, and hence the unit to be replaced in this case is the exposure device 13. The white streak image appears due to the blocking of the laser light, and therefore does not appear in such an image formed without using the laser light described later.

Measurement Chart

In order to specify, from the vertical streak image, the unit (component) which is the cause of the streak, the image forming apparatus 1 forms a measurement chart (measurement image) on the sheet P. A description is made below of an example of forming the measurement chart on the sheet P having an A3 portrait size (297 mm in width direction length and 420 mm in conveyance direction length).

Figure 8:
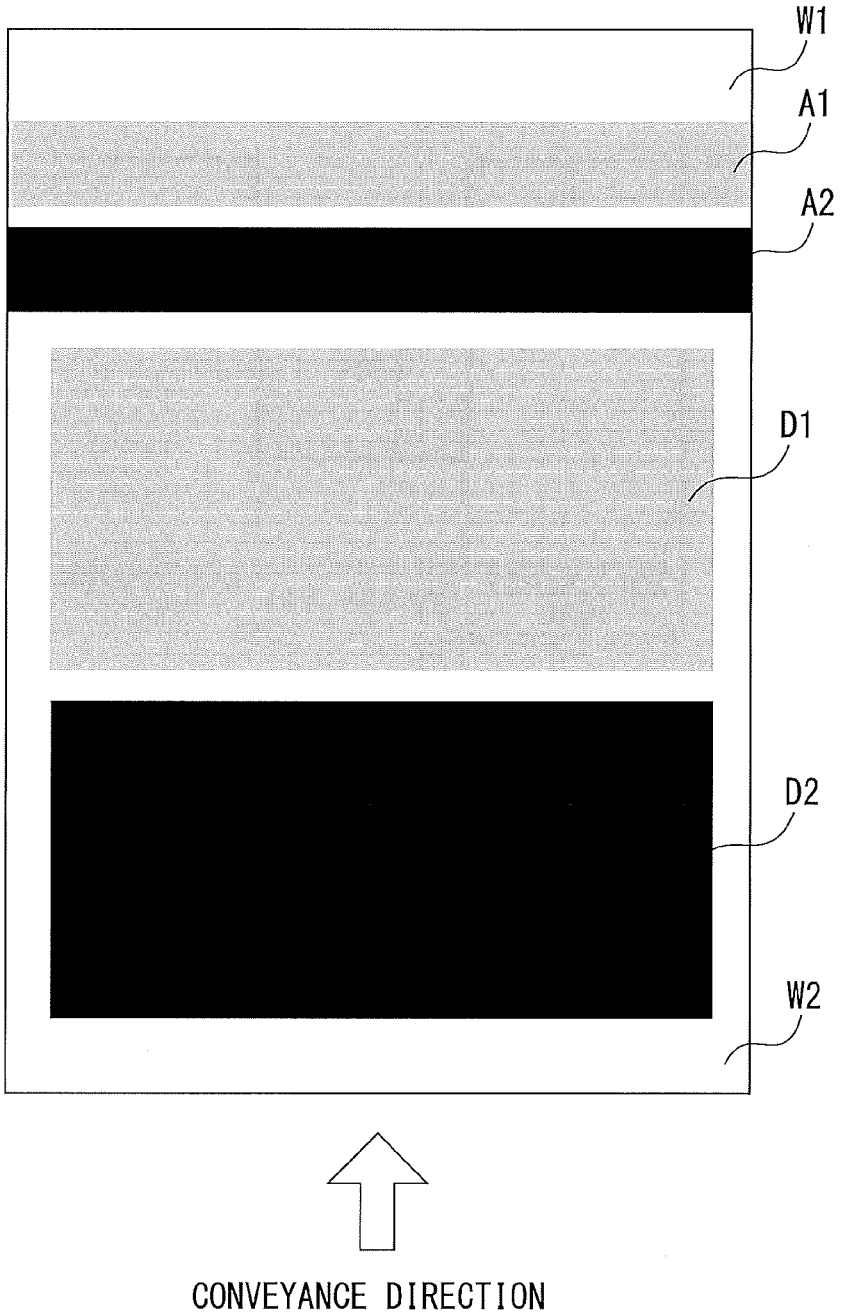
FIG. 8 is a diagram for exemplifying a measurement chart.

FIG. 8 is a diagram for exemplifying the measurement chart. The measurement chart includes white ground parts W1 and W2, an analog image A1 and a digital image D1 that are formed using toners of chromatic colors (yellow, magenta, and cyan), and an analog image A2 and a digital image D2 that are formed using a toner of black. The analog image A1 and the digital image D1 are formed by transferring an image in yellow, an image in magenta, and an image in cyan onto the sheet P with those images being superimposed on each other. The digital images are each an image formed using the irradiation with the laser light emitted from the exposure device 13. The analog images are each an image formed without using irradiation with the laser light emitted from the exposure device 13.

Figure 9A:
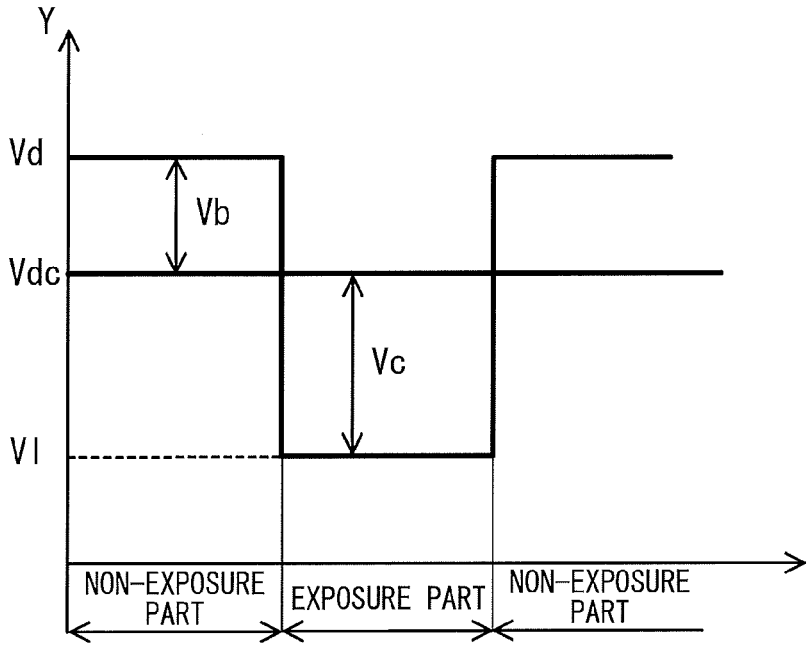
FIG. 9A and FIG. 9B are graphs for showing relationships between a potential of the photosensitive drum and a developing bias.
Figure 9B:
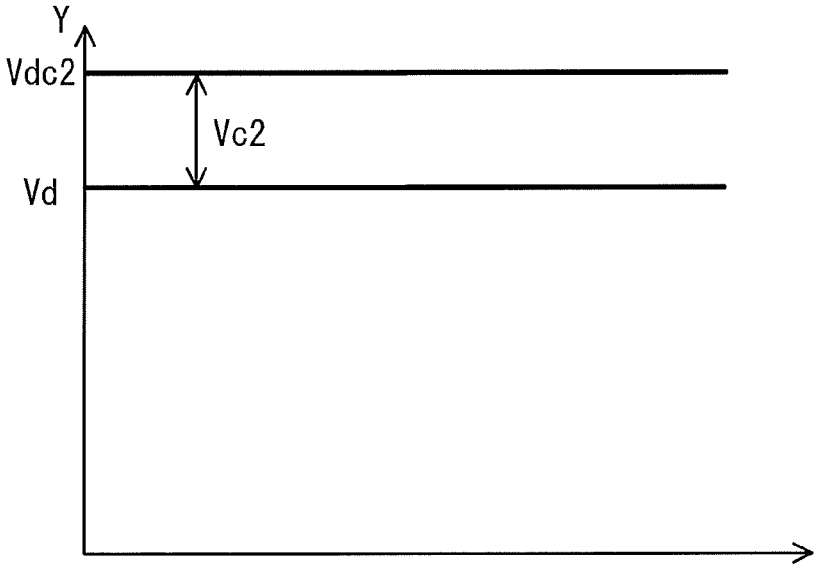

A description is made of formation methods for the digital images D1 and D2 and the analog images A1 and A2. FIG. 9A and FIG. 9B are graphs for showing relationships between a potential of the photosensitive drum 11 and a developing bias applied to the developing sleeve 142 which are exhibited when the digital images D1 and D2 and the analog images A1 and A2 are respectively formed. In FIG. 9A and FIG. 9B, the Y-axis indicates a surface potential of the photosensitive drum 11. In the image forming apparatus 1, the developing device 14 agitates the toner, to thereby charge the toner to a negative polarity.

When the digital images D1 and D2 are formed, the surface potential of the photosensitive drum 11 is controlled as shown in FIG. 9A. The charging device 12 charges the photosensitive drum 11 so that the surface potential of the photosensitive drum 11 becomes a dark part potential Vd. The exposure device 13 emits the laser light to expose the photosensitive drum 11. The potential of the photosensitive drum 11 in the area irradiated with the laser light corresponds to a bright part potential Vl, and the potential of the photosensitive drum 11 in the area that is not irradiated with the laser light corresponds to the dark part potential Vd. A direct-current developing bias Vdc is applied to the developing sleeve 142. A surface potential of the developing sleeve 142 corresponds to the developing bias Vdc. When the digital images D1 and D2 are formed, the developing bias Vdc is controlled to a value higher than the dark part potential Vd and lower than the bright part potential Vl. The dark part potential Vd is, for example, −400 V, the developing bias Vdc is, for example, −300 V, and the bright part potential Vl is, for example, −100 V. With this configuration, the toner (negative polarity) borne on the developing sleeve 142 adheres to the photosensitive drum 11 in the area (bright part potential Vl) irradiated with the laser light, but does not adhere to the photosensitive drum 11 in the area (dark part potential Vd) that is not irradiated with the laser light.

When the analog images A1 and A2 are formed, the surface potential of the photosensitive drum 11 is controlled as shown in FIG. 9B. The charging device 12 charges the photosensitive drum 11 so that the surface potential of the photosensitive drum 11 becomes the dark part potential Vd. The exposure device 13 does not expose the photosensitive drum 11. Then, a direct-current developing bias Vdc2 is applied to the developing sleeve 142. A surface potential of the developing sleeve 142 corresponds to the developing bias Vdc2. When the analog images A1 and A2 are formed, the developing bias Vdc2 is controlled to a value lower than the dark part potential Vd. The dark part potential Vd is, for example, −400 V, and the developing bias Vdc2 is, for example, −550 V. With this configuration, the toner (negative polarity) borne on the developing sleeve 142 adheres to the photosensitive drum 11 in an area opposed to the developing sleeve 142.

A difference between the bright part potential Vl and the developing bias Vdc is referred to as "developing potential difference Vc". A difference between the dark part potential Vd and the developing bias Vdc is referred to as "developing potential difference Vb". A difference between the dark part potential Vd and a developing bias Vdc2 is referred to as "developing potential difference Vc2". The developing potential difference Vc exhibited when the digital images D1 and D2 are formed is different from the developing potential difference Vc2 exhibited when the analog images A1 and A2 are formed. The image forming apparatus 1 switches the developing bias when using the developing bias, to thereby form the analog images A1 and A2 and the digital images D1 and D2.

The analog images A1 and A2 of the measurement chart are formed to have a conveyance direction length of, for example, approximately 30 mm, which allows detection of whether or not an exposure white streak has appeared. The digital images D1 and D2 have a conveyance direction length of, for example, 100 mm, which allows detection of the white streak image ascribable to the scratch that has appeared on the photosensitive drum 11. The above-mentioned length is a length that allows the white streak image ascribable to the scratch that has appeared on the photosensitive drum 11 to be positively detected on the photosensitive drum 11 having a circumferential length of approximately 94.2 mm.

The analog image A1 and the digital image D1 of the measurement chart are both formed with the images in the chromatic colors of yellow, magenta, and cyan being superimposed on each other. The image reading section 200 according to this embodiment is configured to cause the light receiver 205 to receive the light reflected from the original 201 after passing the reflected light through filters of red, blue, and green. The light receiver 205 receives a cyan component bypassing the reflected light through the filter of red, a yellow component bypassing the reflected light through the filter of blue, and a magenta component by passing the reflected light through the filter of green. When the image in black is superimposed on the images in other colors, it is difficult for the light receiver 205 to receive the other colors with high precision. Therefore, in the measurement chart according to this embodiment, the image in black and the images in the other chromatic colors are formed separately from each other. With this configuration, according to this embodiment, it is possible to positively detect the vertical streak image.

Determination of Replacement Unit

Figure 10:
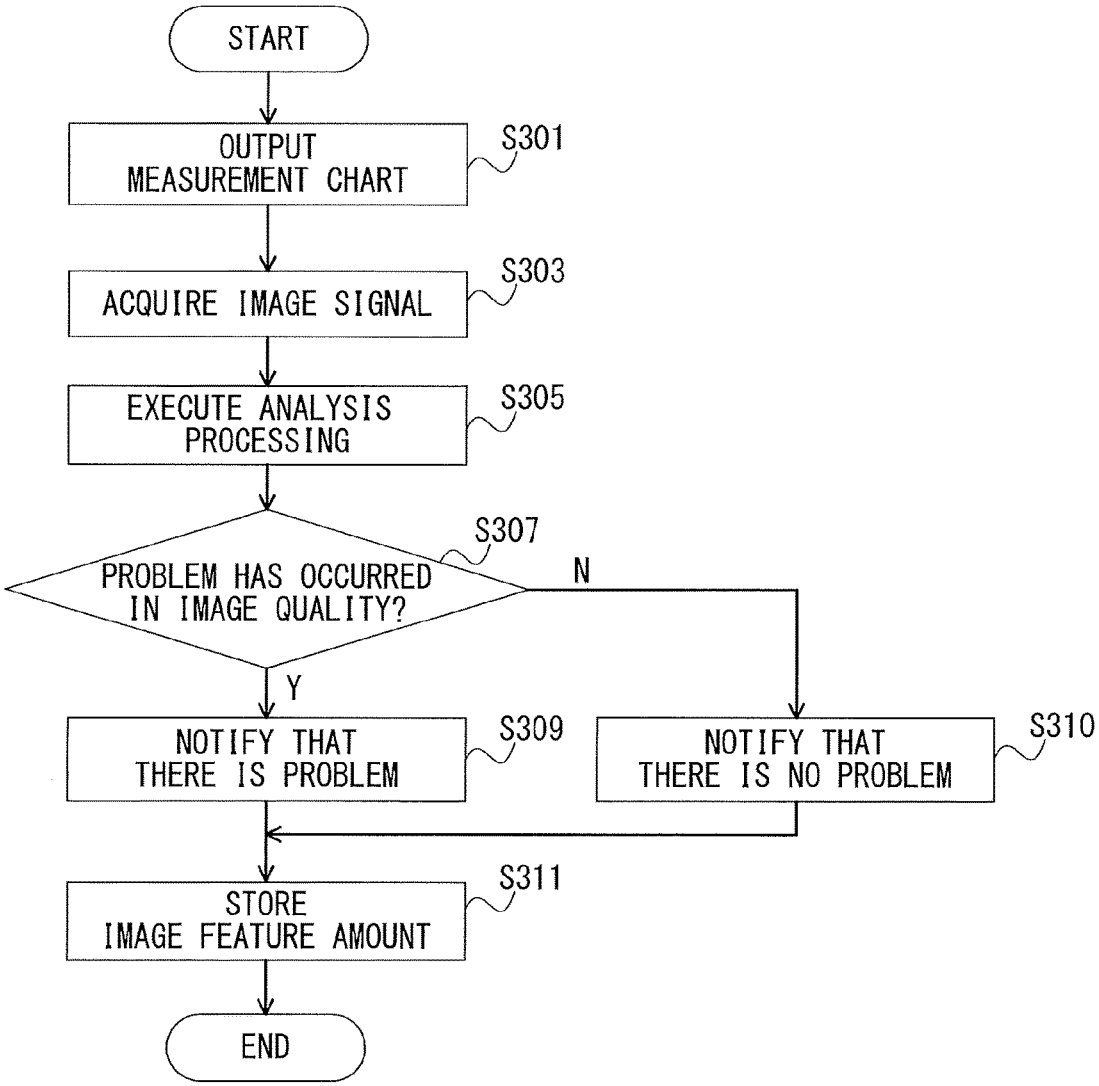
FIG. 10 is a flowchart for illustrating image diagnostic processing.

FIG. 10 is a flowchart for illustrating the image diagnostic processing conducted by the image forming apparatus 1 configured as described above. The controller 102 of the image forming apparatus 1 executes the image diagnostic processing in response to an instruction to diagnose the image, which is issued by the user or a service person through the input portion 120.

When acquiring the instruction to diagnose the image, the controller 102 of the image forming apparatus 1 causes the printer section 4 to form the measurement chart exemplified in FIG. 8 on the sheet P and to output the sheet P (Step S301). The output sheet P is placed on the original table 202 of the image reading section 200 by the user or the service person. The controller 102 causes the image reading section 200 to execute an operation for reading the measurement chart. The image reading section 200 reads the measurement chart, and outputs read data (image signal) corresponding to a result of reading the measurement chart to the controller 102. The controller 102 acquires the read data (image signal) on the measurement chart output from the image reading section 200 (Step S303).

The controller 102 executes analysis processing for the acquired read data (image signal) on the measurement chart to acquire an image feature amount (Step S305). In this embodiment, the controller 102 analyzes the vertical streak image based on the measurement chart. The controller 102 analyzes the image signal of the measurement chart, and stores a raster image of the measurement chart in the raster image storage portion 113. The image diagnostic portion 126 of the controller 102 uses the raster image of the measurement chart to detect a line that meets conditions from the uniform image parts within a surface of the measurement chart. For example, the image diagnostic portion 126 extracts straight lines extending in the conveyance direction of the sheet P and a direction perpendicular to the conveyance direction. The controller 102 measures a width and a length of the extracted line, and acquires a result of the measurement as the image feature amount.

The image diagnostic portion 126 of the controller 102 compares the image feature amount with a predetermined threshold value to determine whether or not a problem has occurred in image quality (Step S307). In this case, in a case where the width of the line being the image feature amount is wider than a threshold value Wth, or in a case where the length of the line is longer than a threshold value Lth, the image diagnostic portion 126 determines that the vertical streak image has appeared in the measurement chart. In short, the controller 102 determines that a problem has occurred in the image quality.

When a problem has occurred in the image quality (Y in Step S307), the controller 102 causes the display portion 118 to notify that there is a problem in the image quality (Step S309). FIG. 11 is a diagram for exemplifying a notification image displayed on the display portion 118 when there is a problem in the image quality. In this example, such a specific message as to be easily understood by the user or the service person and information converted into a code are displayed. The notification image of FIG. 11 includes details of the problem in the image quality and a name of the unit that has caused the problem. When no problem has occurred in the image quality (N in Step S307), the controller 102 causes the display portion 118 to notify that there is no problem in the image quality (Step S310). The controller 102 stores the image feature amount in the storage portion 121 after the notification of a result of diagnosing the image quality (Step S311). In this manner, the occurrence of the problem in the image quality and the replacement unit are notified by displaying a specific message, which allows the user or the service person to easily determine the unit that needs to be replaced.

Figure 12:
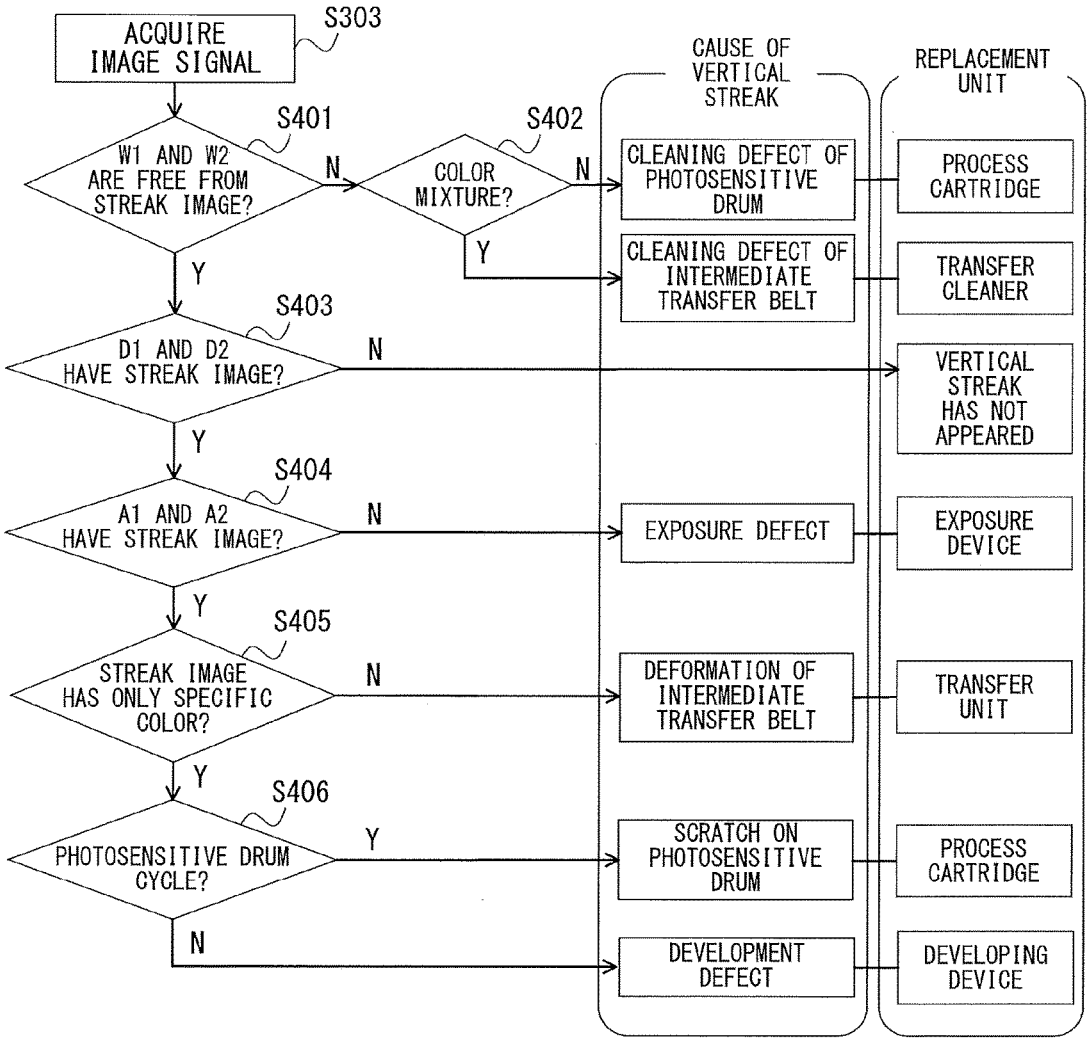
FIG. 12 is an explanatory diagram of processing for determining a unit that has caused appearance a vertical streak.

FIG. 12 is an explanatory diagram of processing for determining the unit that has caused the appearance of a vertical streak. This processing corresponds to the processing of Step S305 and Step S307 of FIG. 10.

The image diagnostic portion 126 of the controller 102 uses the raster image of the measurement chart to determine whether or not the white ground parts W1 and W2 are free from the appearance of the streak image having a vertical streak shape and a chromatic color (Step S401). When the streak image has appeared (N in Step S401), the image diagnostic portion 126 determines whether or not the streak image exhibits a color mixture (Step S402). When the identified color is a single color of yellow, magenta, cyan, or black (N in Step S402), the image diagnostic portion 126 determines that the streak image is ascribable to the cleaning defect of the photosensitive drum. In this case, the controller 102 determines that the process cartridge 50 for the corresponding color is the replacement unit, and displays to that effect on the display portion 118. When the identified color is a color mixture (Y in Step S402), the image diagnostic portion 126 determines that the appearance of the streak image is ascribable to the cleaning defect of the intermediate transfer belt 31. In this case, the controller 102 determines that the transfer cleaner 38 is the replacement unit, and displays to that effect on the display portion 118.

In a case where no streak image has appeared in the white ground part W1 or W2 (Y in Step S401), the image diagnostic portion 126 uses the raster image of the measurement chart to determine whether or not the streak image has appeared in the digital images D1 and D2 (Step S403). In a case where no streak image has appeared (N in Step S403), the controller 102 determines that no vertical streak has appeared, and displays to that effect on the display portion 118.

In a case where the streak image has appeared in the digital images D1 and D2 (Y in Step S403), the image diagnostic portion 126 determines whether or not the white streak image having a vertical streak shape has appeared in the analog images A1 and A2 (Step S404). In a case where no streak image has appeared (N in Step S404), the image diagnostic portion 126 determines that the appearance of the streak image within the digital images D1 and D2 is ascribable to the exposure defect. In this case, the controller 102 displays an image for instructing to clean or replace the exposure device 13 on the display portion 118.

In a case where the white streak image has appeared in the analog images A1 and A2 (Y in Step S404), the image diagnostic portion 126 determines whether or not the color of the streak image that has appeared in the digital images D1 and D2 is only a specific color (Step S405). In a case where the color of the streak image includes all the colors of yellow, magenta, cyan, and black (N in Step S405), the image diagnostic portion 126 determines that the appearance of the streak image is ascribable to the plastic deformation of the intermediate transfer belt 31. In this case, the controller 102 determines that the transfer unit is the replacement unit, and displays to that effect on the display portion 118.

In a case where the color of the streak image that has appeared in the digital images D1 and D2 is a specific color among yellow, magenta, cyan, and black (Y in Step S405), the image diagnostic portion 126 examines appearance cycle of the streak image along the conveyance direction. The image diagnostic portion 126 determines whether or not the streak image is ascribable to the scratch on the photosensitive drum 11 based on whether or not the appearance cycle of the streak image corresponds to a rotation cycle of the photosensitive drum 11 (Step S406).

In a case where the appearance cycle of the streak image is the same as the circumferential length of the photosensitive drum 11, which is 94.2 mm (Y in Step S406), the image diagnostic portion 126 determines that the appearance of the streak image is ascribable to the scratch on the photosensitive drum 11. In this case, the controller 102 determines that the process cartridge 50 for the color identified in the processing of Step S405 is the replacement unit, and displays to that effect on the display portion 118. In a case where the appearance cycle of the streak image is different from the circumferential length of the photosensitive drum 11 (N in Step S406), the image diagnostic portion 126 determines that the appearance of the streak image is ascribable to a coating defect of the developing device 14. In this case, the controller 102 determines that the developing device 14 for the color identified in the processing of Step S405 is the replacement unit, and displays to that effect on the display portion 118.

The above-mentioned processing using the measurement chart allows the image forming apparatus 1 to determine the unit that has caused the streak image and needs to be replaced. The image forming apparatus 1 displays the unit that needs to be replaced on the display portion 118, to thereby greatly reduce a time period necessary for the user or the service person to identify the cause of the streak image. This greatly reduces downtime of the image forming apparatus 1 that occurs due to maintenance. It is also possible to positively identify the unit that has caused the appearance of the streak image, which prevents a unit irrelevant to the appearance of the streak image from being replaced, and suppresses a wasteful maintenance cost.

In this embodiment, the measurement chart includes the analog image A1 and the digital image D1 that are obtained by superimposing yellow, magenta, and cyan on each other, and hence the image diagnostic processing can be conducted with one sheet P having the measurement chart formed thereon. Hitherto, at least two A3-size sheets P are required when analog images and digital images are respectively formed in yellow, magenta, and cyan. Hence, in this embodiment, inconvenience felt by the user or the service person causing the image forming apparatus 1 to read the sheet P having the measurement chart printed thereon through the image reading section 200 can be suppressed to a minimum level. It is also possible to minimize the number of sheets P required for identifying the unit that has caused the streak image.

The measurement chart of FIG. 8 is merely an example, and the layout of the white ground parts W1 and W2, the analog images A1 and A2, and the digital images D1 and D2 is not limited thereto. A measurement chart obtained by arranging those images in another order can produce the same effect by the above-mentioned processing. In this embodiment, as conditions for forming the analog images A1 and A2 and the digital images D1 and D2, the dark part potential of the photosensitive drum 11 is fixed, while the developing bias is changed. The controller 102 controls a charging voltage applied to the charging device 12 so that the surface potential of the photosensitive drum 11 charged by the charging device 12 becomes the dark part potential Vd. Then, the controller 102 controls the direct-current developing bias applied to the developing sleeve 142 to a first value Vdc and a second value Vdc2. However, the dark part potential of the photosensitive drum 11 may be changed while the developing bias is fixed. The controller 102 controls the direct-current developing bias applied to the developing sleeve 142 to a predetermined value Vdc. Then, the controller 102 controls the dark part potential of the photosensitive drum 11 to a first value Vd1 and a second value Vd2. For example, the first value Vd1 is set to −400 V, and the second value Vd2 is set to −200 V. In short, the controller 102 may change at least one of the dark part potential and the developing bias to form the analog images A1 and A2 and the digital images D1 and D2.

The measurement chart includes the analog image A1 and the digital image D1 that are obtained by superimposing yellow, magenta, and cyan on each other, but the present invention is not limited thereto. For example, the measurement chart may independently include an analog image and a digital image, which are obtained by superimposing any two colors among yellow, magenta, and cyan on each other, and an analog image and a digital image, which are formed in the remaining one color. Even such a measurement chart allows the unit that has caused the streak image to be identified. The measurement chart may independently include analog images and digital images that are formed in the respective colors of yellow, magenta, cyan, and black. Such a measurement chart allows the unit that has caused the streak image to be identified, but the number of sheets P to be used becomes larger.

The image forming apparatus 1 according to this embodiment notifies the replacement unit by displaying a notification to that effect on the display portion 118, but the notification may be conducted by another method. For example, the image forming apparatus 1 may notify the replacement unit to an information processing apparatus possessed by the service person through the network 123. In this case, the service person can prepare the replacement unit in advance, and can efficiently conduct the maintenance.

Figure 13A:
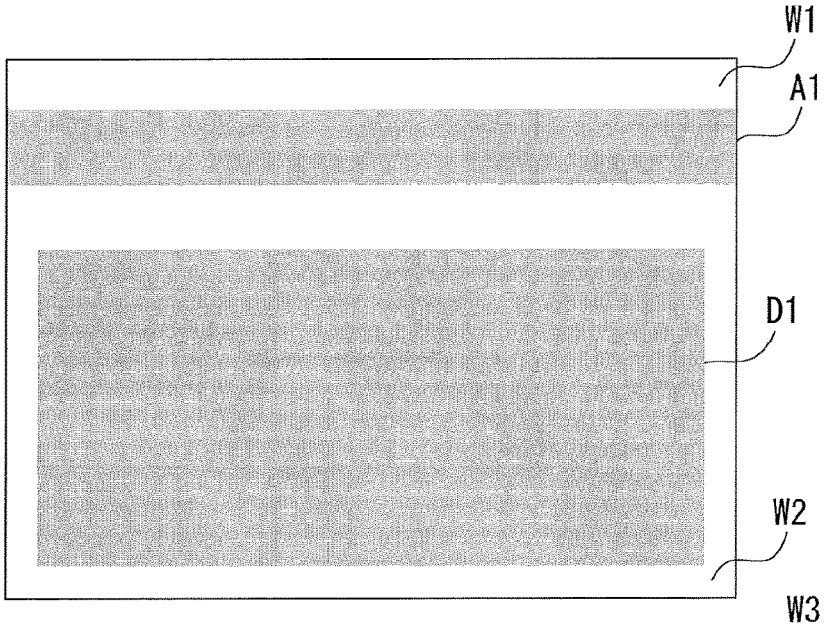
FIG. 13A and FIG. 13B are diagrams for exemplifying the measurement chart.
Figure 13B:
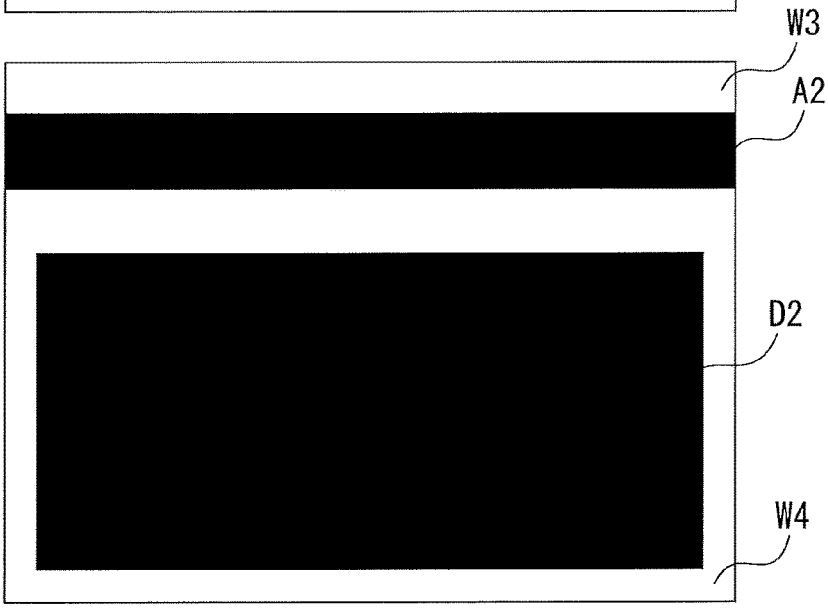

The images of the measurement chart illustrated in FIG. 8 are formed on the A3-size sheet P, but may be separately formed on two sheets P having an A4 size (297 mm in width direction length and 210 mm in conveyance direction length). In general, an image forming apparatus is more likely to use the A4 size than the A3 size as the size of the sheet P. For that reason, it is useful to provide measurement charts for the A4 size capable of producing the same effect as the measurement chart for the A3 size. FIG. 13A and FIG. 13B are diagrams for exemplifying the measurement charts provided in such a case.

FIG. 13A is a first measurement chart, and includes the white ground parts W1 and W2, the analog image A1 obtained by superimposing the chromatic colors of yellow, magenta, and cyan on each other, and the digital image D1 obtained by superimposing the chromatic colors of yellow, magenta, and cyan on each other. FIG. 13B is a second measurement chart, and includes white ground parts W3 and W4, the analog image A2 in black, and the digital image D2 in black. The image forming apparatus 1 can cause the image reading section 200 to read two sheets P having such measurement charts formed thereon, and can identify the unit that has caused the appearance of the streak image by such processing as described with reference to FIG. 10 and FIG. 12.

As described above, the image forming apparatus 1 according to this embodiment detects the streak image ascribable to a replaceable component based on as small a number of sheets P as possible, and positively identifies the component, to thereby suppress the downtime. It is also possible to reduce wasteful work, e.g., the replacement of the component that does not need to be replaced, and to reduce costs in terms of time and price. Accordingly, the image forming apparatus 1 can appropriately determine that an abnormality has occurred in the component.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-018647, filed Feb. 3, 2016 which is hereby incorporated by reference herein in its entirety.

What is claimed is:

1. An image forming apparatus, comprising:

a first image forming unit configured to form an image in a first chromatic color;

a second image forming unit configured to form an image in a second chromatic color different from the first chromatic color; and a controller configured to:

control the first image forming unit and the second image forming unit to form, on a sheet, a superimposed measurement image in which a first measurement image in the first chromatic color is superimposed on a second measurement image in the second chromatic color;

acquire read data relating to the superimposed measurement image formed on the sheet;

analyze the read data; and detect a streak image within the first measurement image and a streak image within the second measurement image based on a result of the analysis, wherein:

the read data is output from a reading device;

the first image forming unit comprises:

a first photosensitive member;

a first charging unit configured to charge the first photosensitive member;

a first exposure unit configured to expose the first photosensitive member to form an electrostatic latent image on the first photosensitive member; and a first developing unit configured to develop the electrostatic latent image on the first photosensitive member using a developer of the first chromatic color on a first sleeve;

the second image forming unit comprises:

a second photosensitive member;

a second charging unit configured to charge the second photosensitive member;

a second exposure unit configured to expose the second photosensitive member to form an electrostatic latent image on the second photosensitive member; and a second developing unit configured to develop the electrostatic latent image on the second photosensitive member using a developer of the second chromatic color on a second sleeve;

the controller is configured to control the first image forming unit so that an absolute value of a first developing bias applied to the first sleeve becomes larger than an absolute value of a surface potential of the first photosensitive member charged by the first charging unit in order to form the first measurement image; and the controller is configured to control the second image forming unit so that an absolute value of a second developing bias applied to the second sleeve becomes larger than an absolute value of a surface potential of the second photosensitive member charged by the second charging unit in order to form the second measurement image.

2. An image forming apparatus according to claim 1, further comprising a third image forming unit configured to form an image in black, wherein:

the third image forming unit comprises:

a third photosensitive member;

a third charging unit configured to charge the third photosensitive member;

a third exposure unit configured to expose the third photosensitive member to form an electrostatic latent image on the third photosensitive member; and a third developing unit comprising a third sleeve to which a third developing bias is to be applied, and being configured to develop the electrostatic latent image on the third photosensitive member using a black developer on the third sleeve;

the controller is further configured to:

control the third image forming unit to form a measurement image in black on another sheet;

acquire read data relating to the measurement image in black formed on the other sheet; and detect a streak image within the measurement image in black based on the read data relating to the measurement image in black; and the controller is configured to control the third image forming unit so that an absolute value of the third developing bias becomes larger than an absolute value of a surface potential of the third photosensitive member charged by the third charging unit in order to form the measurement image in black.

3. An image forming apparatus according to claim 1, wherein:

the controller is configured to form the first measurement image without causing the first exposure unit to expose the first photosensitive member; and the controller is configured to form the second measurement image without causing the second exposure unit to expose the second photosensitive member.

4. An image forming apparatus according to claim 1, wherein the controller is further configured to determine a unit that does not satisfy a predetermined condition based on a result of detecting the streak image.

5. An image forming apparatus according to claim 4, further comprising a notifying unit configured to notify of the determined unit.

6. An image forming apparatus according to claim 1, wherein:

the first photosensitive member and the second photosensitive member each have a cylindrical shape;

the first measurement image has a length longer than an outer circumferential length of the first photosensitive member; and the second measurement image has a length longer than an outer circumferential length of the second photosensitive member.

7. A control method for an image forming apparatus, the image forming apparatus comprising:

a first image forming unit configured to form an image in a first chromatic color; and a second image forming unit configured to form an image in a second chromatic color different from the first chromatic color, the first image forming unit comprising:

a first photosensitive member;

a first charging unit configured to charge the first photosensitive member;

a first exposure unit configured to expose the first photosensitive member to form an electrostatic latent image on the first photosensitive member; and a first developing unit configured to develop the electrostatic latent image on the first photosensitive member using a developer of the first chromatic color on a first sleeve, the second image forming unit comprising:

a second photosensitive member;

a second charging unit configured to charge the second photosensitive member;

a second exposure unit configured to expose the second photosensitive member to form an electrostatic latent image on the second photosensitive member; and a second developing unit configured to develop the electrostatic latent image on the second photosensitive member using a developer of the second chromatic color on a second sleeve, the control method comprising:

forming a first measurement image by controlling the first image forming unit;

forming a second measurement image by controlling the second image forming unit;

forming, on a sheet, a superimposed measurement image obtained by superimposing the first measurement image and the second measurement image on each other;

reading the superimposed measurement image using a reading device;

analyzing read data on the superimposed measurement image;

detecting a streak image within the first measurement image; and detecting a streak image within the second measurement image, wherein:

in a case where the first measurement image is formed, an absolute value of a first developing bias applied to the first sleeve is larger than an absolute value of a surface potential of the first photosensitive member charged by the first charging unit; and in a case where the second measurement image is formed, an absolute value of a second developing bias applied to the second sleeve is larger than an absolute value of a surface potential of the second photosensitive member charged by the second charging unit.

* * * * *